US008388365B2

(12) United States Patent
Takahashi et al.

(10) Patent No.: US 8,388,365 B2
(45) Date of Patent: Mar. 5, 2013

(54) SEMICONDUCTOR DEVICE BURN-IN TEST SOCKET

(76) Inventors: Hideyuki Takahashi, Fujishi (JP); Kiyokazu Ikeya, Shizuoka (JP)

( * ) Notice: Subject to any disclaimer, the term of this patent is extended or adjusted under 35 U.S.C. 154(b) by 123 days.

(21) Appl. No.: 12/734,933

(22) PCT Filed: Nov. 18, 2008 (Under 37 CFR 1.47)

(86) PCT No.: PCT/JP2008/070899

§ 371 (c)(1), (2), (4) Date: Jun. 3, 2010

(87) PCT Pub. No.: WO2009/072388

PCT Pub. Date: Jun. 11, 2009

(65) Prior Publication Data

US 2010/0248518 A1 Sep. 30, 2010

(30) Foreign Application Priority Data

Dec. 4, 2007 (JP) ..... 2007-313167

(51) Int. Cl.
*H01R 13/62* (2006.01)

(52) U.S. Cl. ..... 439/331; 439/70

(58) Field of Classification Search ..... 439/70–73, 439/330, 331, 525
See application file for complete search history.

(56) References Cited

U.S. PATENT DOCUMENTS

| | | | | |
|---|---|---|---|---|
| 6,666,691 | B2 * | 12/2003 | Ikeya | 439/71 |
| 6,848,928 | B2 * | 2/2005 | Ikeya et al. | 439/331 |
| 6,863,553 | B2 * | 3/2005 | Watanabe | 439/330 |
| 7,722,376 | B2 * | 5/2010 | Kobayashi | 439/331 |
| 7,887,355 | B2 * | 2/2011 | Watanabe | 439/331 |

* cited by examiner

*Primary Examiner* — Thanh Tam Le
(74) *Attorney, Agent, or Firm* — Chapin IP Law, LLC

(57) ABSTRACT

Provided is a socket which protects an upper surface of a semiconductor device from being scratched due to contact, by using a latch plate. A socket (10) includes a base member (20), a cover member (30) that reciprocates in a direction to be close to or separated from the base member (20), a plurality of contacts (40), an adaptor (50) that moves in a direction to be close to or separated from the base member and provides a surface for placing a semiconductor package, a latch member (60) that rotationally shifts with reciprocation of the cover member (30), and a latch plate (70) connected to the latch member (60). The latch plate (70) prevents the leading edge of the latch member (60) from being directly brought into contact with a Ball Grid Array (BGA), and presses down the BGA placed on the adaptor (50) in the vertical direction.

8 Claims, 12 Drawing Sheets

10 Socket (a) Perspective view A (b) Perspective view B

50 Adaptor

SEMICONDUCTOR DEVICE BURN-IN TEST SOCKET

TECHNICAL FIELD

The present invention relates to a socket for a semiconductor device whose terminals are arranged in two dimensions, and more particularly, to socket for Ball Grid Array (BGA), Land Grid Array (LGA) packages and so on.

BACKGROUND

Semiconductor devices such as BGA and LGA are subjected to burn-in test that applies the stress due to a high temperature before shipping. This test can remove the occurrence of defects of semiconductor devices within a predetermined period from the shipment. Generally, there are two kinds of sockets used for burn-in test. One is an open-type socket that reciprocates a cover member in a vertical direction. The other is a clamshell-type socket that rotates a cover member. The open-type socket is disclosed, for example, in the patent document 1 or the patent document 2. The patent document 1 provides a socket that can appropriately attach or detach an electronic device including surface mount semiconductor device such as BGA and CPS.

According to the patent document 1, the socket includes a base member, a cover member, a plurality of contacts, an adaptor that can move in a direction to be close to or separated from the cover member and provide a mounting surface for BGA, a latch member attached to base member rotatably, and a positioning mechanism that can move in response to the movement of the cover member. A positioning portion of the positioning mechanism can move over the mounting surface of the adaptor in a diagonal direction and can position and hold the mounted BGA. And, solder balls are separated from the other end of the contact while the BGA package is held by the positioning mechanism, the jumping of BGA package from the mounting surface is prevented, thereby increasing the efficiency of automatic loading of BGA package on the socket.

According to the patent document 2, a socket includes a base member, a cover member attached reciprocatably in a direction to be close to or separated from the base member, a plurality of contacts that are fixed in the base member and electrically connect to each terminal of LGA device mounted on the mounting surface of the main body of the base member, and a latch member supported by the base member rotatably. A swinging member is provided on the leading edge of the latch member, and it is designed that the swinging member presses the LGA device. Therefore, the thin type of semiconductor device is certainly mounted without being damaged.

The patent document 1: U.S. Pat. No. 3,737,078

The patent document 2: Patent publication No. 2003-168532

Problems to be Solved by the Invention

The conventional open-type socket presses the top surface of semiconductor device by the rotational movement of the latch member. Thus, when the semiconductor device is pressed, the leading edge of the latch member is forced to move in the horizontal direction while pressing the top surface of semiconductor device. Result of this, the top surface of semiconductor device might be scratched due to the latch member. These scratches cause the semiconductor device to be rejected during the visual inspection, and such device cannot be shipped as the products.

The purpose of the present invention is to solve the above-described conventional problems and to provide a socket for preventing scratches on the top surface of semiconductor device by using the latch plate.

Meanings for Solving the Problems

A socket according to the present invention comprising a base member; a cover member for reciprocating in a direction to be close to of separated from the base member; a plurality of contacts, each contact is fixed in the base member, each contact having a elastically deformable portion between both ends; a latch member supported on the base member rotatably and for rotating in response to the cover member, the latch member being at a position for pressing an electronic device when the cover member is separated from the base member, and the latch member being at an evacuated position when the cover member is closed to the base member; a latch plate provided on a pressing portion of the latch member, the latch plate being able to press the surface of the electronic device in a vertical direction when the latch member is at the position for pressing; and a mounting member for providing a mounting surface for the electronic device and movable up and down with respect to the base member; wherein the mounting member is formed with a latch plate guide for moving the latch plate in the vertical direction when the latch plate presses the electronic device.

Preferably the pressing portion of the latch member is formed with a projection, and the projection is received in an elongated slot formed in the latch plate, and the projection is moved in the slot when the latch member is rotated. Preferably the latch plate is urged by a spring member in a direction to be separated from the latch member and the latch plate is moved in the vertical direction against the spring force of the spring member. The latch plate includes a pair of sidewalls and the pressing portion for coupling the end portions of the sidewalls and the pressing portion includes a plane first main surface and the first main surface is parallel to the top surface of the electronic device when the latch plate is moved in the vertical direction.

Preferably, the latch member is received in a space formed between a pair of the sidewalls and the pressing portion of the latch member presses a second main surface opposite to the first main surface. The pressing portion slides on the second main surface when the latch member is rotated.

Preferably, the latch plate includes a sliding portion opposite to the pressing portion and the sliding portion slides on the latch plate guide. Also, the mounting surface of the mounting member is formed with a plurality of through holes at the positions corresponding to the plurality of contacts, and when the mounting member is moved toward the base member, one end of each contact is projected from each through hole of the mounting member, and when the mounting member is moved away from the base member, one end of each contact is received within each through hole.

Effect of the Invention

According to the socket of the present invention, by using the latch plate, the top surface of semiconductor device can be protected from being scratched. This leads the improvement of yield of semiconductor device.

BEST MODE FOR CARRYING OUT THE INVENTION

A socket according to the present invention is suitably executed as a measuring socket. Disclosed hereinafter is detail of the present invention with reference to the Figures.

Embodiments

FIG. 1 is figures showing configurations of the socket according to the present invention, FIG. 1(*a*) is a plan view, FIG. 1(*b*) is a side view, and FIG. 1(*c*) is a front view. Also, FIG. 2 is a sectional view taken at line X-X of FIG. 1(*a*). FIG. 3 is a perspective views showing the appearance of the socket.

A socket 10 according to an embodiment has developed for semiconductor devices such as BGA and LGA. The socket 10 can, for example, attach and detach BGA package 1 as illustrated in FIG. 4. The BGA package 1 is formed with ball-shaped terminals (solder balls) 3 at the bottom surface 2 and the terminals 3 are arranged in two-dimensions. For example, four lines of the solder balls 3 with 0.5 mm pitch are disposed at the periphery. Each solder ball 3 is projected 0.25 mm from the bottom surface of package, and the height of the whole package is 0.93 mm.

The socket 10 includes a base member 20, a cover member 30 that can reciprocate in a direction to be close to or separated from the base member 20, and a plurality of the contacts 40 fixed in the base member 20. The base member 20 and the cover member 30 are formed, for example, by injection molding of Poly Ether Sulfone (PES) with high heatproof resin. Besides PES, Poly Phenylene Sulfide (PPS), Liquid Crystal Polymer (LCP), Poly Sulfone (PSF), Polyarylate (PAR), and Poly Ether imide might be used.

In the sectional view illustrated in FIG. 2, the aligned contacts 40 and the sheet-shaped separator 22 in the approximately center of the base member 20 are alternately located parallel to the direction of line X-X of FIG. 1(*a*). Each line of the contacts 40, that is, Y-direction is electrically isolated by the separator 22. In this way, the contacts 40 and the separator 22 are laminated, the contact unit 24 is installed, in which the contacts 40 are positioned in X and Y directions and are electrically isolated, and the contacts 40 are arranged in the matrix array of two-dimension.

The contact unit 24 is received within the base member from the below and is fixed firmly by the shaft member etc. At this point, the bottom surface of contact unit 24 is aligned with the bottom surface of the base member 20, the lower ends of contacts 40 protrude therefrom. It is noted that the size of the separator 22 might be changed according to the number of terminals and/or the terminal pitch of mounted BGA package 1.

The contacts 40 are formed by stamping or etching a metal plate such as platy beryllium copper. The lower ends of contacts 40 protrude from the bottom surface of the base member 20 and are connected to the conductive contacts of the circuit board (not shown in Fig.) by soldering. The upper ends of contacts 40 are electrically connected to the solder balls 3 of the BGA package 1. An elastically deformable portion which is curved in the Y-direction (not shown in Fig.) is formed in between the upper and lower ends of the contacts 40. When the upper ends of the contacts 40 are contacted with the solder balls 3 and the bucking load is applied in the axial direction of the contacts 40, the elastically deformable portion generates the elastic force against the bucking load, thereby generating the necessary contact pressure between the upper ends of the contacts 40 and the solder balls 3.

Back to the FIG. 1, posts 31 extended downward are formed in each corner of the cover member 30, the posts 31 are inserted into receiving holes respectively (not shown in the Fig) formed at each corner of the base member 20. Coil springs 32 are winded around the corresponding the posts 31 between the cover member 30 and the base member 20, the cover member 30 is constantly urged by the coil spring 32 in a direction to be separated from the base member 20.

A pair of slots 34 are formed at the opposite sidewalls 33 of the cover member 30 and the slots 34 engage with the rotation axis 61 of the latch member 60, which is explained hereinafter. The slot 34 defines the stroke of the up-and-down direction of the cover member 30, when the rotation axis 61 abuts on the lowest portion of the slot 34, the cover member 30 is positioned at the farthest place from the base member 20, and when the rotation axis 61 abuts on the highest portion of the slot 34, the cover member 30 is positioned at the nearest place to the base member 20 against the spring 32. A rectangular opening 35 is formed in the center of the cover member 30 and the BGA package 1 is mounted on the adaptor 50 through the opening 35.

The adaptor 50 movable in the up-and-down directions is installed on the adaptor mounting surface 26 in the center of the base member 20 (shown in FIG. 2) and provides a mounting surface 52 for the BGA package 1. FIG. 5 shows the configurations of adaptor, FIG. 5(*a*) is a plan view, FIG. 5(*b*) is a side view and FIG. 5(*c*) is a front view. FIG. 6 is a cross sectional view taken at line X-X of FIG. 5(*a*).

A pair of hooks 54 which are extending downwardly from the bottom is provided at the both sides of the adaptor 50, and the hooks 54 engage with a pair of openings (not shown in Fig.) formed in the base member 20. The adaptor 50 is constantly urged in a direction to be separated from the base member 20 by the coil spring not shown in the figure and the adaptor 50 is prevented from detaching by the engagement of the hooks 54 and the openings. If a force greater than the coil spring is applied to the adaptor 50, the adaptor 50 can move downwardly against the coil spring.

The mounting surface 52 of the adaptor 50 is formed with a plurality of the through holes 55, which correspond to the position of the contact unit 24 of the base member 20, that is, each contact 40, and the upper ends of the contacts 40 protruding from the adaptor mounting surface 26 extend into the through holes 55. When the adaptor 50 is at the highest position urged by the coil spring, the upper ends of the contacts 40 stay inside of the through holes 55 without projecting from the mounting surface 52, whose position is slightly below the mounting surface 52.

Rising guide portions 56 with inclined surfaces are formed at the peripheries of the mounting surface 52 of the adaptor 50. Each guide portion 56 guides the BGA package 1 along the inclined surface to conducts it onto the mounting surface 52. Furthermore, plate guide portions 58 are formed at adjacent to the guide portion 56 to guide the latch plate 70 in the vertical direction. Each plate guide portion 58 includes a step configuration including an inclined surface 58*a* and a vertical surface 58*b*, by contacting the part of latch plate 70 with the step configuration, the latch plate 70 is moved along the plate guide portion 58, therefore, the pressing portion of the latch plate 70 is conducted to be parallel to the upper surface of the BGA package 1 and the mounting surface 52 without like an arc movement.

A positioning mechanism, which is not shown in Fig, is installed in the corner 59 of the adaptor 50. The positioning mechanism includes a pressing member that moves in the diagonal direction of the mounting surface 52, in response to the reciprocating movement of the cover member 30, the BGA package 1 can be positioned by pushing it in the diagonal direction by the pressing member. Please note that the adaptor 50 might be removed from the base member 20 and be modified based on the size and type of the IC package to be mounted.

FIG. 7 shows configurations of the latch member, FIG. 7(*a*) is a plan view, FIG. 7(*b*) is a side view, and FIG. 7(*c*) is a front view. FIG. 8 shows configurations of the latch plate attached at the leading edge of the latch member, FIG. 8(*a*) is a plan view, FIG. 8(*b*) is a side view, and FIG. 8(*c*) is a front view. FIG. 9 shows the connection of the latch member and the latch plate.

The latch member 60 includes a pair of the rotating axes 61 formed at the both sides, a pressing portion 64 having an arc-shaped surface extending from the rotating axis 61 to one side, and an extending portion 66 extending from the rotating axis 61 to other side. A pair of cylindrical projections 62 is formed at the both sides of the pressing portion 64, and an elongated slot 63 is formed in the extending portion 66 along its extending direction. A pair of the latch members 60 is attached on the base member 20, so that it can be rotated around the rotating axis 61.

As shown in FIG. 8, the latch plate 70 includes a pair of sidewalls 72 and L-shaped pressing portion 78 coupling one end of the sidewall 72 each other. An elongated slot 74 is formed at each sidewall 72. A pair of projections 76 is formed at other end of each sidewall 72, and a projection 79 is also formed at the center of the pressing portion 78.

As shown in FIG. 9, the latch member 60 is provided at the space formed between a pair of the sidewalls 72 of the latch plate 70, and the latch plate 70 is attached at the leading edge of the pressing portion 64 of the latch member 60. In other words, the projection 62 of the latch member 60 is inserted into the slot 74 of the latch plate 70. Preferably, the width or the vertical space of the slot 74 is slightly larger than the diameter of the projection 62, the projection 62 of the latch member 60 can move within the slot 74 in the vertical direction with respect to the axis and the latch member 60 can pivot around the projection 62 as the fulcrum. A coil spring 67 is also intervened between the projection 79 of the pressing portion 78 and a recess of the latch member 60, the projection 62 is contacted with one end of the slot 74 by the coil spring 67, and the latch plate 70 is urged to be separated therefrom.

When the rotating axis 61 of the latch member 60 is provided with the base member 20 and the latch member 60 is rotated in response to the movement of the cover member 30, two projections 76 formed on each sidewall 72 of the latch plate 70 are slid on the plate guide portion 58 of the adaptor 50, this movement is different from the arc movement of the latch member 60, which leads to the vertical motion that is guided by the plate guide portion 58. Because of this, the horizontal or level surface of the pressing portion 78 of the latch plate 70 is changed from the rotational movement to the vertical movement before the BGA package 1 is contacted, thereby pressing the BGA package 1 vertically. It is noted that the latch member 60 and the latch plate 70 may be removed from the base member 20 and/or modified based on the size and type of IC package to be mounted.

The latch member 60 connected to, the latch plate 70 is provided in parallel with the longitudinal direction of adaptor 50. As shown in FIG. 2, links 80 are provided at both sides of a pair of the latch members 60. An axis 82 provided at one end 81 of the link 80 is received in the elongated hole 63 of latch member 60. Other end 83 of the link 80 is supported to the cover member 30 rotatably by an axis 84. One end 81 of the link 80 is able to slide on a cam surface 28 formed in the base member 20.

The cover member 30 is moved toward the base member 20 and the axis 82 of the link 80 is contacted with the cum surface 28, then the link 80 starts to rotate around the axis 84. One end 81 of the link 80 starts to slide along the cum surface 28, the axis 82 of the link 80 is guided in the elongated slot 63, thereby rotating the latch member 60 at the axis 61 centrally. The leading edges of each latch member 60 rotate from the just above the adaptor 50 outwardly as if depicting the circular tracks, and when the cover member 30 is pushed down sufficiently or full stroked, the leading edge of the latch member 60 and the latch plate 70 are moved to the outermost position or the evacuated position.

Next, operations of the socket according to the present embodiment are described below. As FIG. 2 illustrates the statuses from the left portion to the right portion, the cover member 30 is pressed downwardly during mounting the BGA package 1, then the link 80 is rotated in response to the movement of the cover member 30, the latch member 60 is rotated by the rotation of the link 80, and the leading edge of the latch member 60 and the latch plate 70 are moved from the mounting surface 52 to the evacuated position. According to this, the mounting surface 52 of adaptor 50 is ready to receive the BGA package 1 through the opening 35 of the cover member 30.

While the cover member 30 is pressed, the BGA package 1 is dropped down through the opening 35 of the cover member 30. Then, the BGA package 1 is guided along the guide portion 56 of the adaptor 50 and is seated on the mounting surface 52 of the adaptor 50. At this point, the adaptor 50 is lifted up by the coil spring, and the upper ends of contacts 40 remain in the through holes 55 without projecting from the mounting surface 52. Accordingly, if the BGA package is seated on the mounting surface 52 of the adaptor 50, the upper ends of contacts 40 are not contacted with the solder balls 3. This is illustrated in FIG. 10.

Thereafter, decreasing the pressing force on the cover member 30 gradually, the cover member 30 starts to move upwardly. The link 80 also moves upwardly in response to the movement of the cover member 30, so that the latch member 60 is rotated and the latch plate 70 connected to the leading edge of the latch member 60 is moved inside together.

Then, before the pressing portion 78 of the latch plate 70 is contacted with the BGA package 1, the projections 76 of the latch plate 70 are contacted with the vertical surface 58*b* of the plate guide portion 58 formed in the adaptor 50, the movement of the latch plate 70 is changed from the rotating one in response to the latch member 60 to the vertical one, the latch plate 70 is moved downward with the pressing portion 78 maintained the parallel with the BGA package 1. This allows the latch plate 70 to press the top surface of the BGA package 1 from just above without the arc or horizontal movement. At this point, as illustrated in FIG. 11, the contact point P of the pressing portion 64 of the latch member 60 is shifted in the horizontal direction over the pressing portion 78 of the latch plate 70.

The cover member 30 is moved upwardly furthermore, and then the latch plate 70 pushes the BGA package 1 down more. In this way, the upper ends of contacts 40 are projected from the mounting surface 52 of the adaptor 50 which is pushed downward, finally the upper ends of the contacts 40 are contacted with the solder balls 3. Additionally, the BGA package 1 is pushed down by the rotation of the latch member 60 around the rotating axis 61 until the spring force for lifting the cover member 30 and the contact force of the contacts 40 are balanced. The contact 40 generates the contact force by bending itself depending on the force or amount of displacement applied by the latch member 60, as a result, the contact 40 is electrically connected with the solder balls 3. This is illustrated in FIG. 12.

The BGA package 1 in the condition of FIG. 12 is subjected to a heatproof test (burn-in test). When the BGA package 1 is removed from the socket after burn-in test, the cover member 30 is pushed down from the above like when the BGA package 1 is mounted. By the movements of the link 80 and the latch member 60, the force for pushing the BGA package 1 from the latch plate 70 is released, and the BGA package 1 is pushed upward by the reactive force from the contacts 40. Simultaneously, the adapter 50 is also lifted by the spring. Additionally, the cover member is pushed down, the pressing portion 78 of the latch plate 70 is separated from the top surface of BGA package 1.

The cover member 30 is continuously pushed down, the latch member 60 and the latch plate 70 are escaped from the above of the BGA package 1. According to this, the BGA package 1 is detached through the opening 35 of cover member 30 by a vacuum apparatus.

According to the present invention, the top surface of the semiconductor package can be protected from being scratched by latch member, by connecting the latch plate with the leading edge of the latch member and by restricting the movement of the latch plate in the vertical direction by the adaptor. Additionally, since the latch plate is prevented the arc or circular movement and presses semiconductor package by the flat pressing portion with a certain area, the load per unit area is decreased or the local stress is prevented, thereby preventing the semiconductor package with thin thickness and the small withstand pressure and its internal chip from cracking and/or braking.

Although the preferred embodiment according to the present invention has been described, variations and modifications which may occur to those skilled in the art, should be considered to be within the scope of the present invention.

INDUSTRIAL APPLICABILITY

The socket according to the present invention will be used for semiconductor package in which terminals are disposed two-dimensionally such as BGA and LGA.

BRIEF DESCRIPTION OF THE DRAWINGS

FIG. 1(*a*) is a plan view, FIG. 1(*b*) is a side view, and FIG. 1(*c*) is a front view.

FIG. 2 is a cross sectional view taken at X-X line in FIG. 1 and shows that cover member is in free or full stroked condition when semiconductor device is mounted.

FIG. 5(*a*) is a plan view, FIG. 5(*b*) is a side view, and FIG. 5(*c*) is a front view.

FIG. 6 is a cross sectional view taken at X-X line in FIG. 5(*a*).

EXPLANATION OF NUMBER

Figure 1:
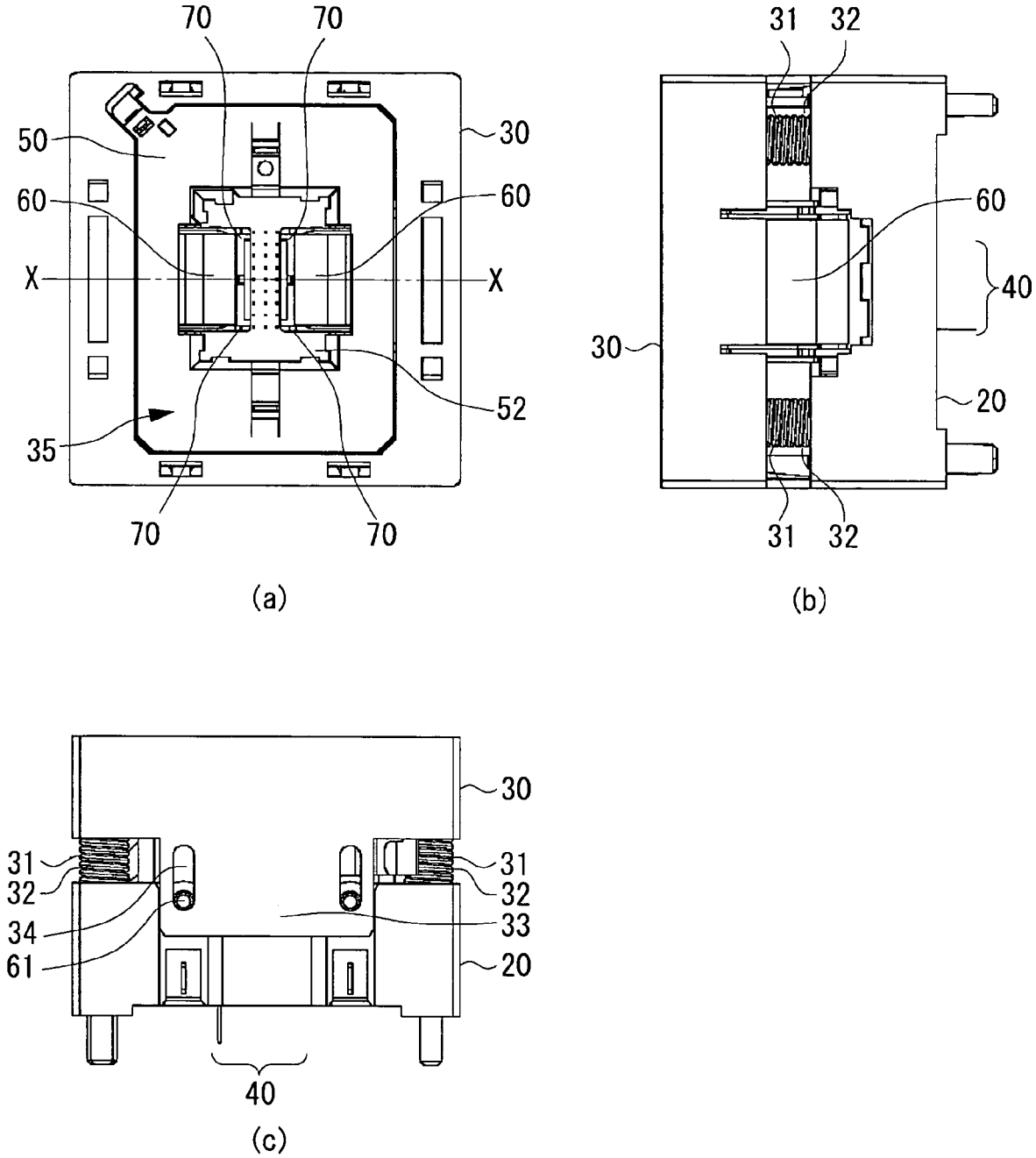
FIG. 1: This figure shows a socket according to an embodiment.
Figure 2:
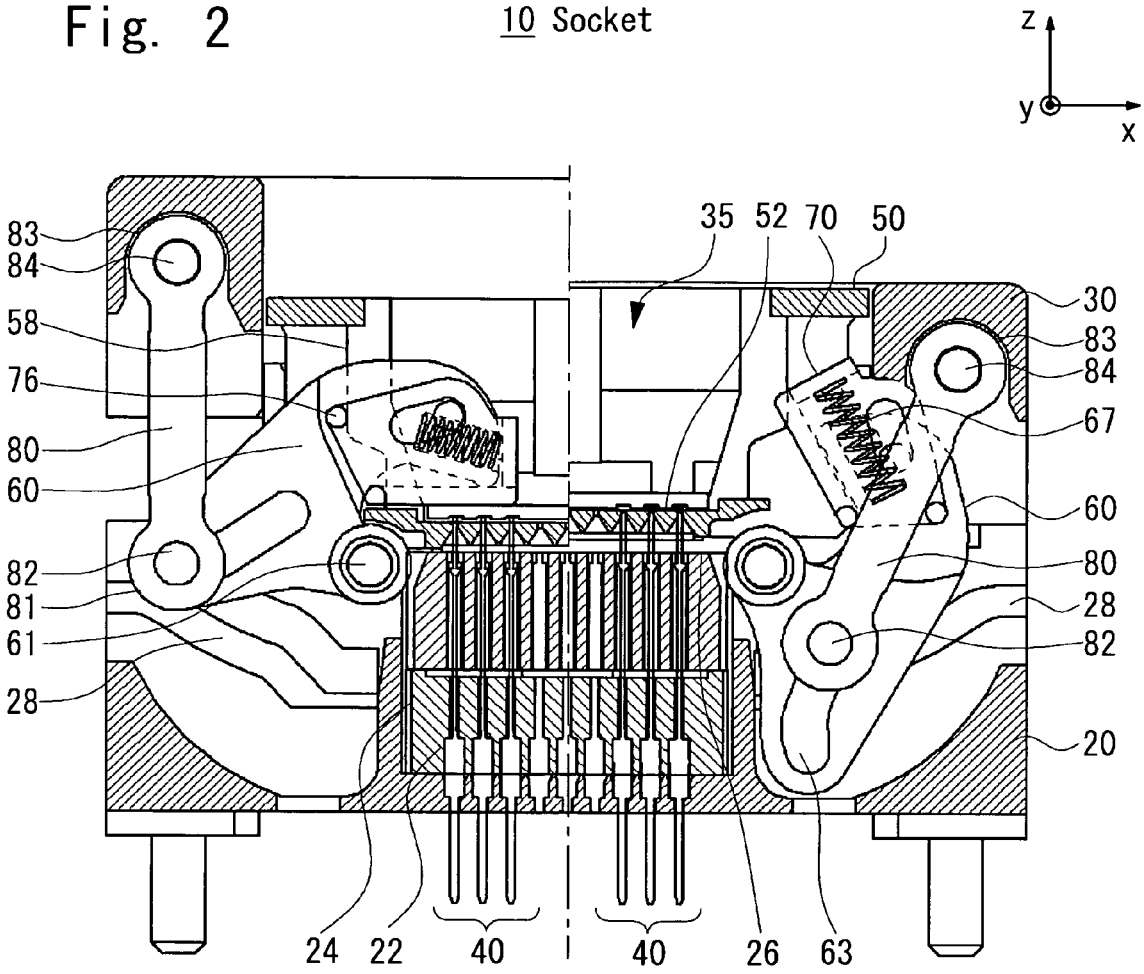
FIG. 2.
Figure 3:
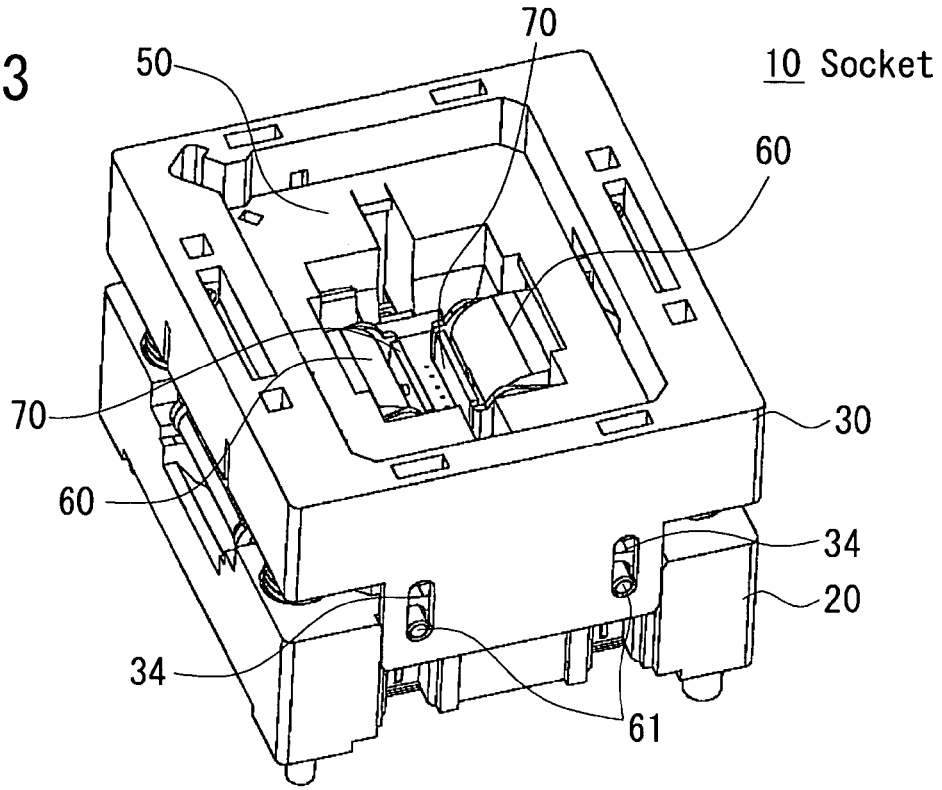
FIG. 3: This is a perspective view of appearance of the socket.
Figure 3:
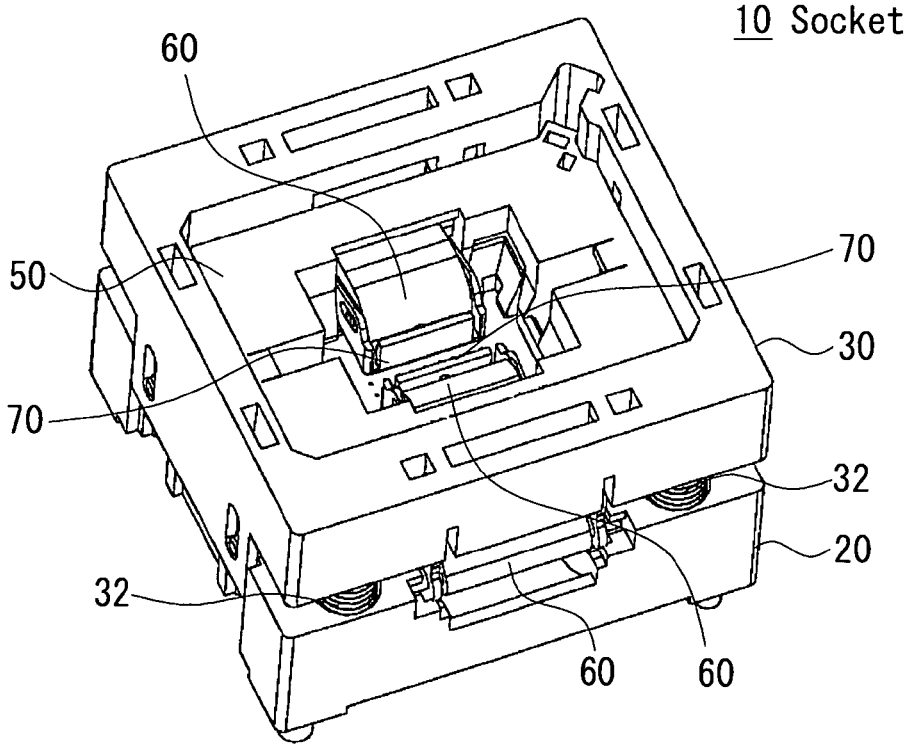
Figure 4:
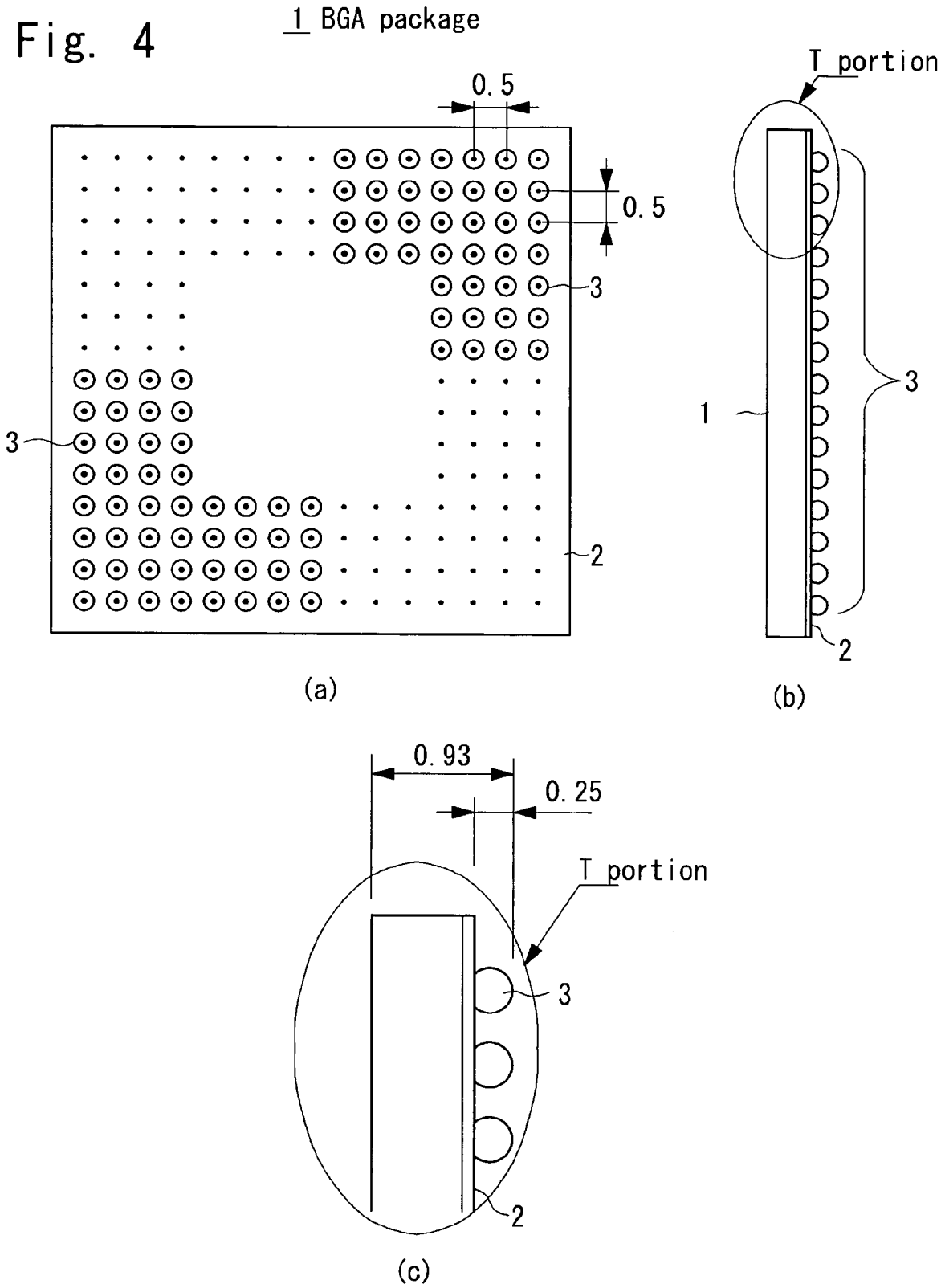
FIG. 4: This shows BGA package.
Figure 5:
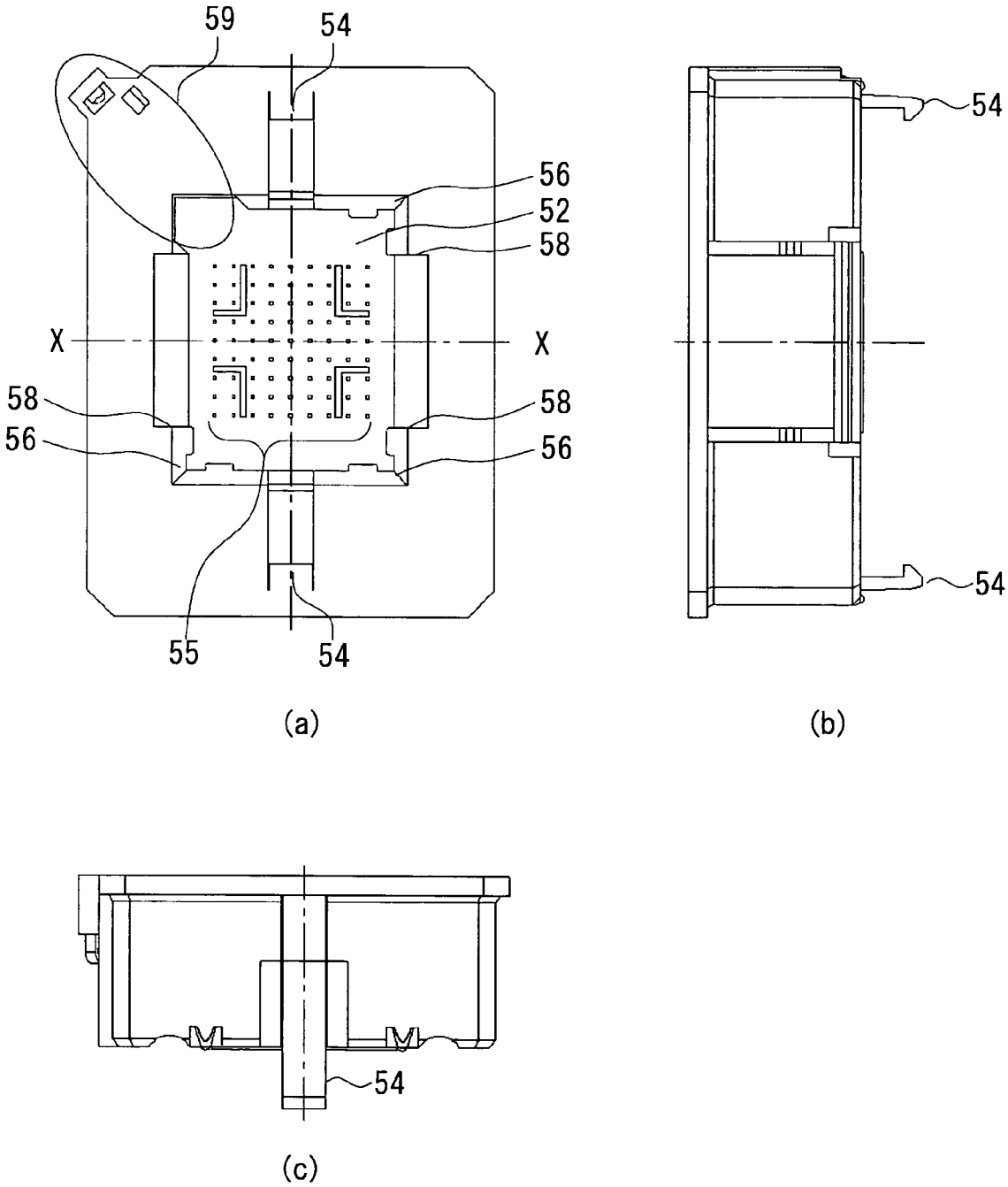
FIG. 5: This shows an adaptor.
Figure 6:
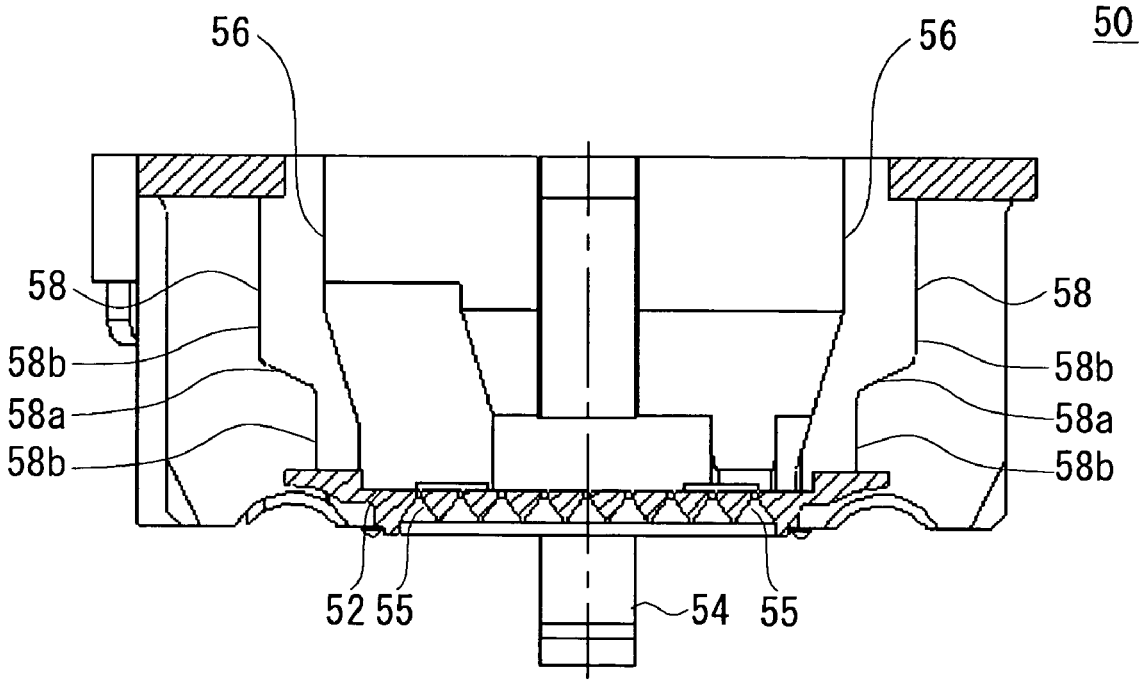
FIG. 6.
Figure 7:
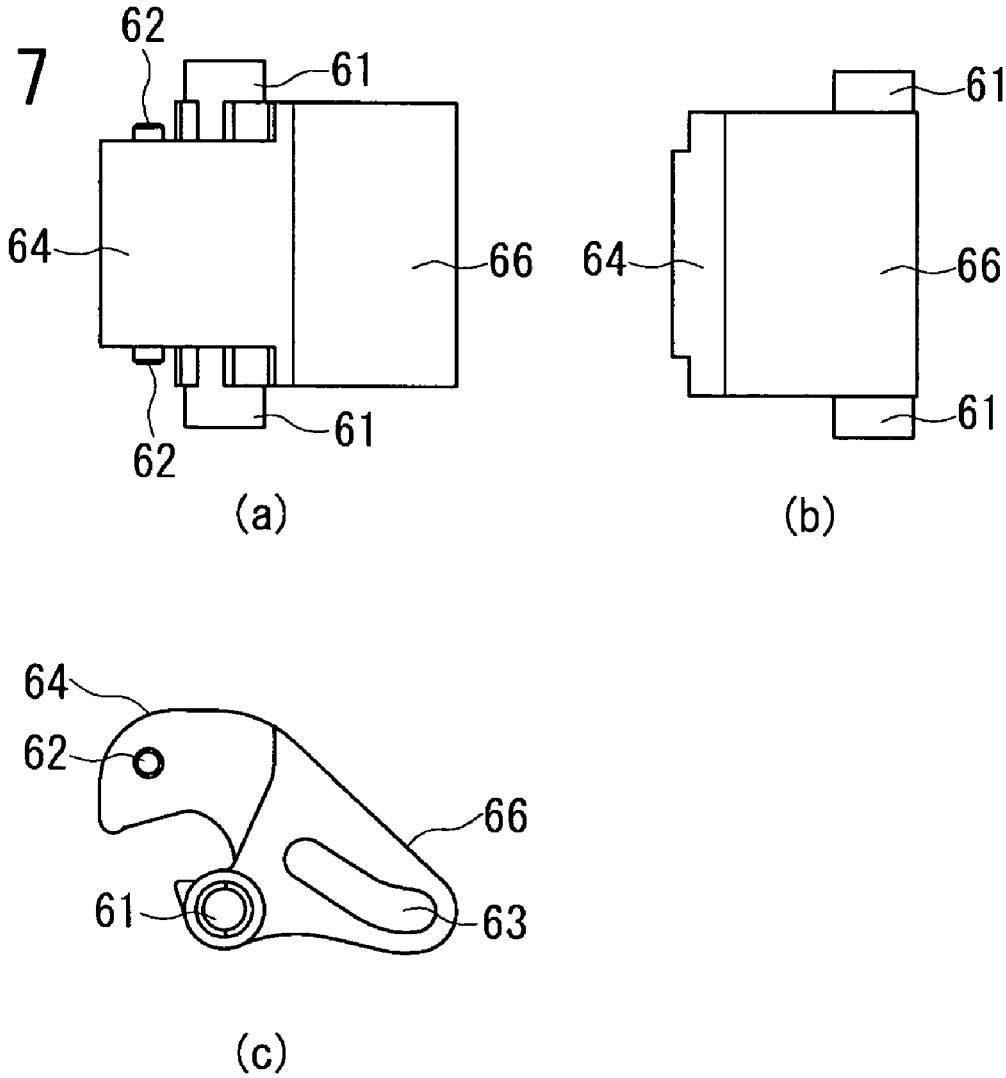
FIG. 7: This shows a latch member.
Figure 8:
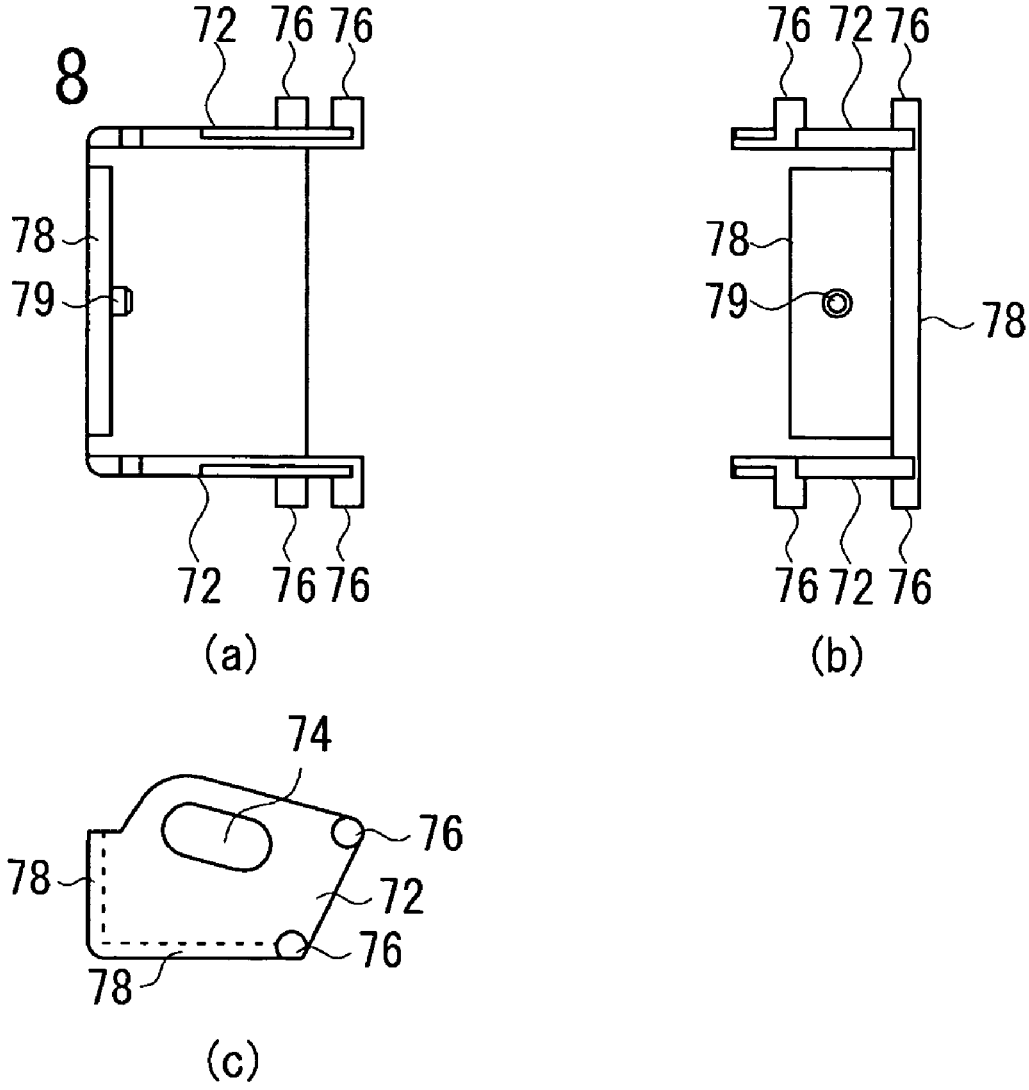
FIG. 8: This shows a latch plate.
Figure 9:
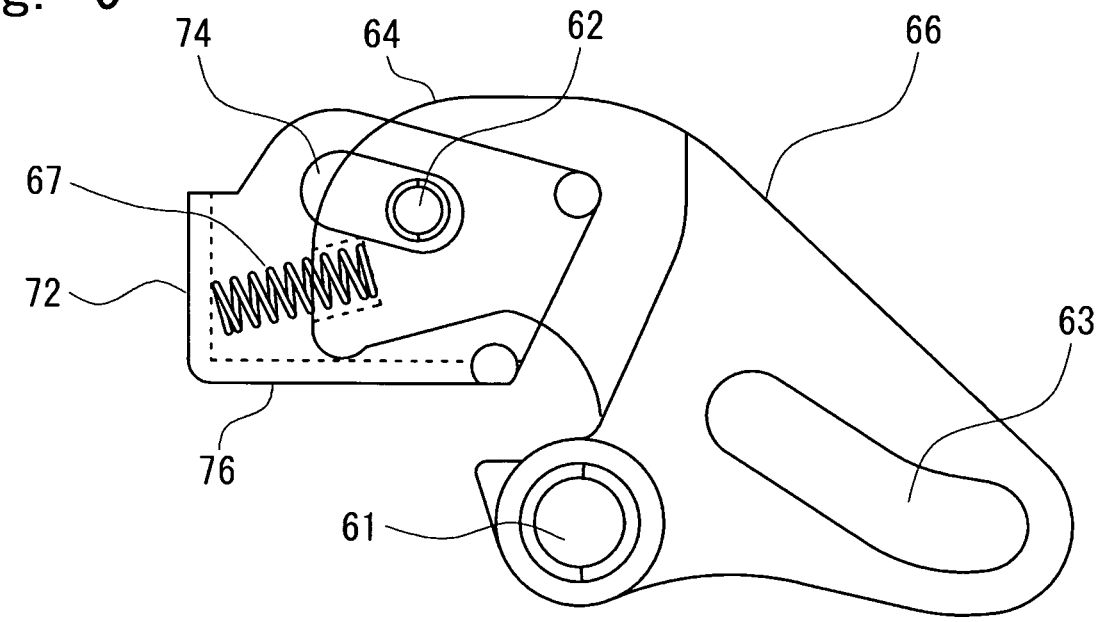
FIG. 9: This is connection diagram between latch member and latch plate.
Figure 10:
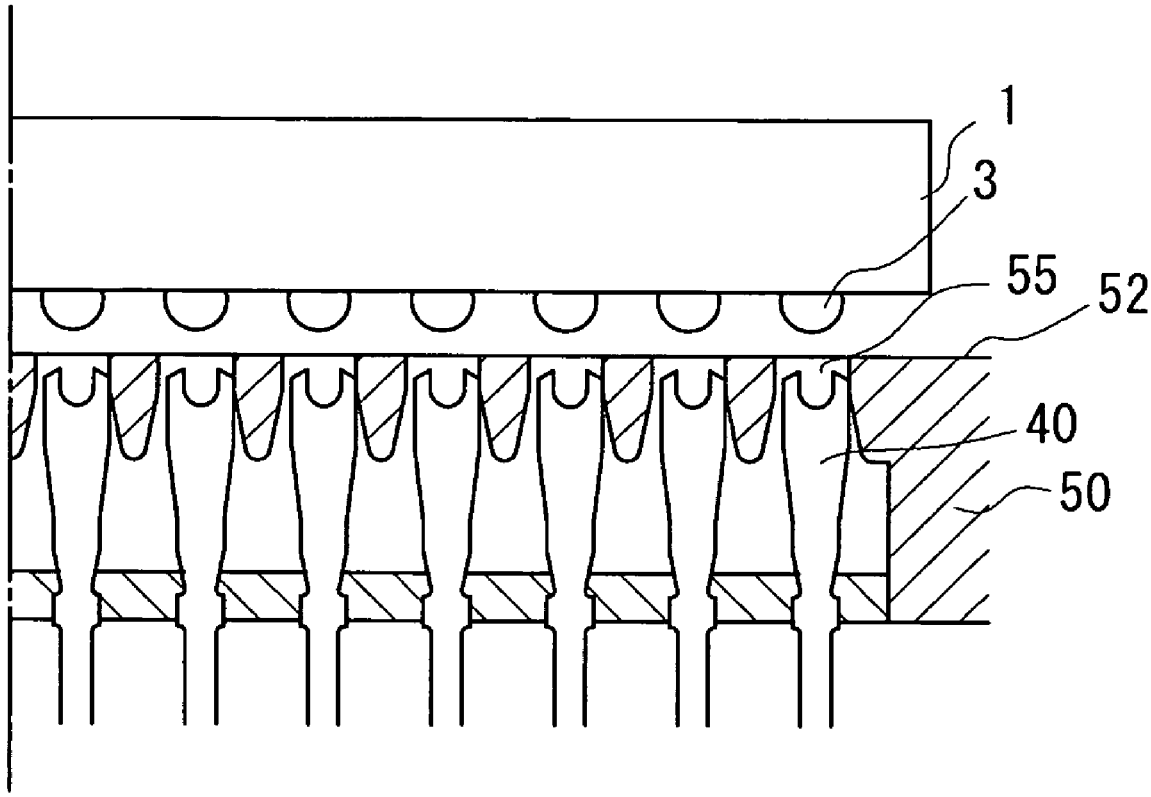
FIG. 10: This is an expanded sectional view describing seated BGA package.
Figure 11:
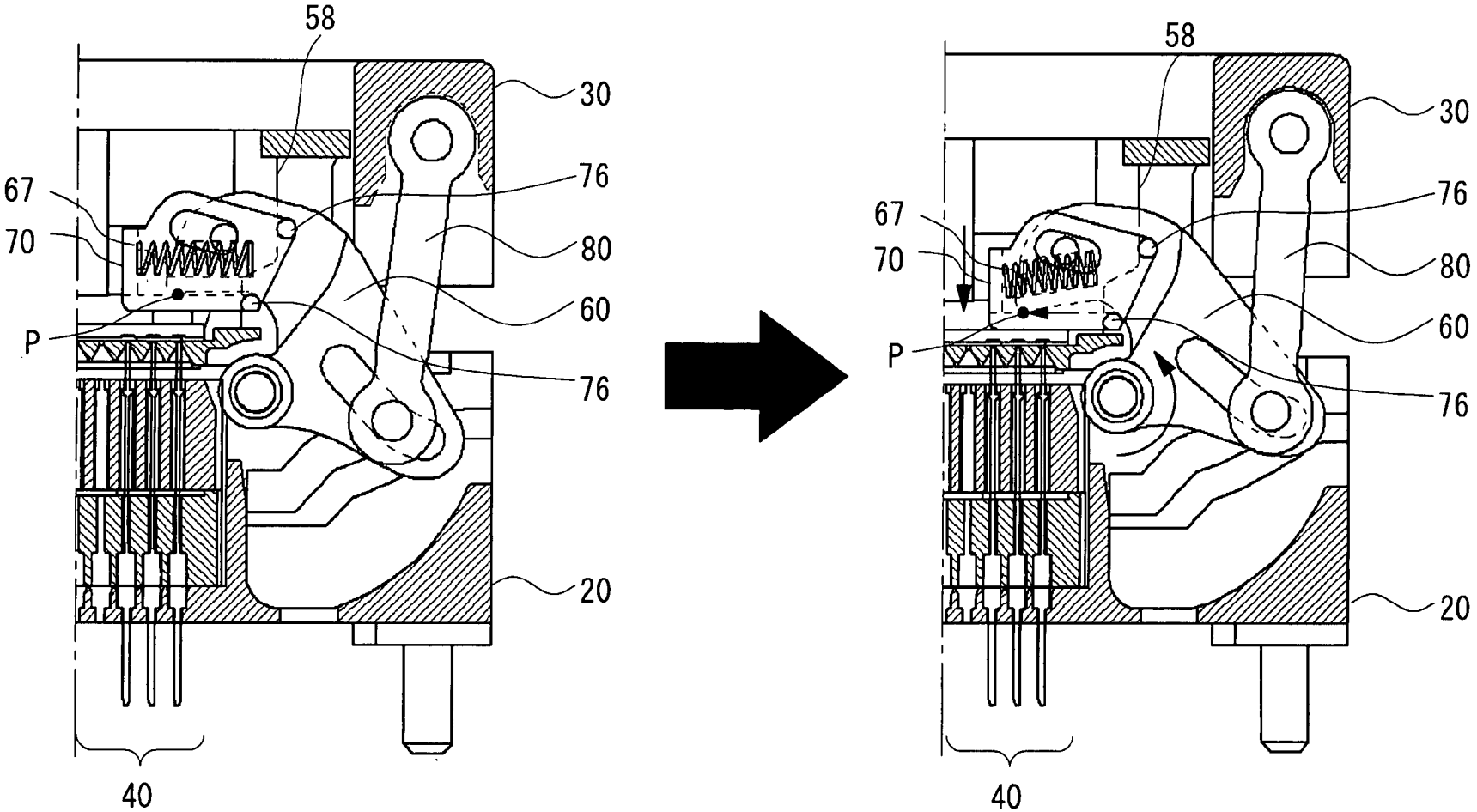
FIG. 11: This shows operations of latch member and latch plate.
Figure 12:
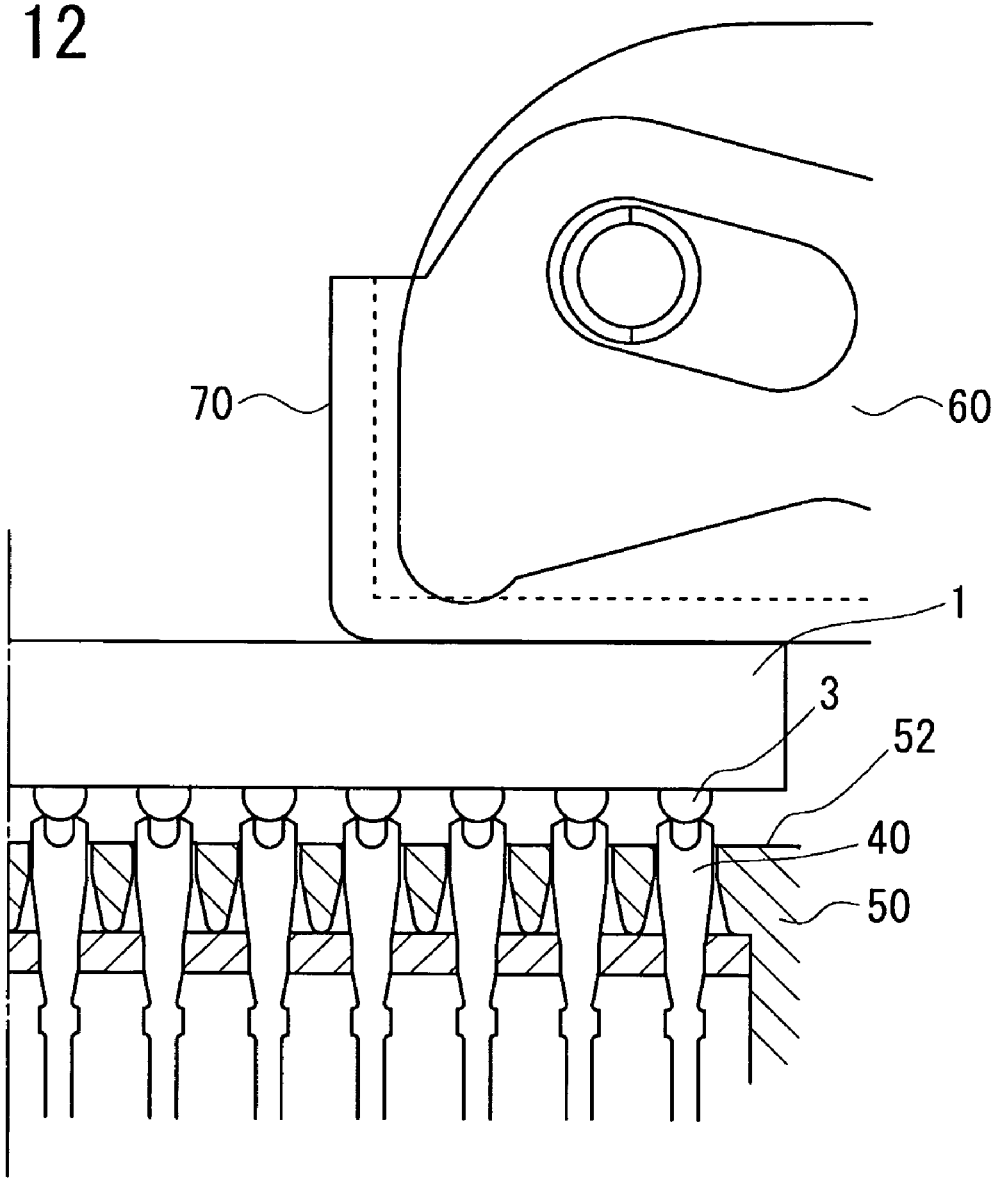
FIG. 12: This shows contacts between the top ends of contact and solder balls.

10: socket
20: base member
22: separator
24: contact unit
26: adaptor mounting surface
28: cum surface
30: cover member
31: post
32: coil spring
33: sidewall
34: slot
40: contact
50: adaptor
52: mounting surface
54: hook
55: through-hole
56: guide portion
58: plate guide portion
59: corner
60: latch member
61: rotational axis
67: coil spring
70: latch plate
76: projection
78: pressing portion

What is claimed:

1. A socket comprising:

a base member;

a cover member for reciprocating in a direction to be close to or separated from the base member;

a plurality of contacts, each contact is fixed in the base member, the each contact having an elastically deformable portion between two ends of the each contact;

a latch member rotatably supported on the base member for rotating in response to movement of the cover member, the latch member being at a position for pressing an electronic device when the cover member is separated from the base member, and the latch member being at an evacuated position when the cover member is close to the base member;

a latch plate provided on a pressing portion of the latch member, the latch plate being able to press the surface of the electronic device in a vertical direction when the latch member is at the position for pressing; and a mounting member for providing a mounting surface for the electronic device, the mounting member being movable up and down with respect to the base member, wherein the mounting member is formed with a latch plate guide for moving the latch plate in the vertical direction when the latch plate presses the electronic device, and wherein the latch plate guide includes a step configuration with an inclined surface and a vertical surface so that the latch plate guide contacts a part of the latch plate with the step configuration when the latch plate is moved along the latch plate guide.

2. The socket in according to claim 1, wherein the pressing portion of the latch member is formed with a projection and the projection is received in an elongated slot formed in the latch plate and the projection is moved in the slot when the latch member is rotated.

3. The socket according to claim 1, wherein the latch plate is urged by a spring member in a direction to be separated from the latch member and the latch plate is moved in the vertical direction against the spring force of the spring member.

4. The socket according to claim 1, 2, or 3, wherein the latch plate includes a pair of sidewalls and the pressing portion for coupling the end portions of the sidewalls and the pressing portion includes a plane first main surface and the first main surface is parallel to the top surface of the electronic device when the latch plate is moved in the vertical direction.

5. The socket according to claims 1, 2 or 3, wherein the latch member is received in a space formed between a pair of the sidewalls and the pressing portion of the latch member presses a second main surface opposite to the first main surface.

6. The socket according to claim 5, wherein the pressing portion slides on the second main surface when the latch member is rotated.

7. The socket according claims 1, 2, or 3, wherein the latch plate includes a sliding portion opposite to the pressing portion and the sliding portion slides on the latch plate guide.

8. The socket according claims 1, 2, or 3, wherein the mounting surface of the mounting member is formed with a plurality of through holes at the positions corresponding to the plurality of contacts and when the mounting member is moved toward the base member one end of each contact is projected from each through hole of the mounting member and when the mounting member is moved away from the base member one end of each contact is received within each through hole.

* * * * *